US005264663A

United States Patent [19]

Noguchi et al.

[11] Patent Number: 5,264,663

[45] Date of Patent: Nov. 23, 1993

[54] JUNCTION STRUCTURE FOR A FLAT CABLE

[75] Inventors: Akira Noguchi, Tokyo; Yoshikazu Hayashi, Aichi, both of Japan

[73] Assignees: The Furukawa Electric Co., Ltd., Tokyo; Kabushiki Kaisha Tokai Rika Denki Seisakusho, Aichi, both of Japan

[21] Appl. No.: 857,331

[22] Filed: Mar. 25, 1992

[30] Foreign Application Priority Data

Mar. 29, 1991 [JP] Japan ..... 3-019995[U]

[51] Int. Cl.[5] ..... H01R 4/02

[52] U.S. Cl. ..... 174/84 R; 174/88 R; 439/460; 439/465; 439/472

[58] Field of Search ..... 174/84 R, 84 S, 88 R, 174/88 S, 75 R; 439/453, 460, 465, 469, 459, 472

[56] References Cited

U.S. PATENT DOCUMENTS

| | | | |
|---|---|---|---|
| 1,742,850 | 1/1930 | Douglas | 439/453 X |
| 3,214,725 | 10/1965 | De Rose et al. | 174/88 S |
| 3,629,787 | 12/1971 | Wilson | 174/88 R X |
| 3,907,396 | 9/1975 | Huber | 439/472 |
| 3,985,416 | 10/1976 | Dola et al. | 174/88 R |
| 4,153,326 | 5/1979 | Frantz et al. | 439/465 X |
| 4,160,575 | 7/1979 | Schraut | 439/460 |
| 4,516,822 | 5/1985 | Wolfel | 439/459 X |
| 4,852,252 | 8/1989 | Ayer | 174/84 R X |
| 5,045,641 | 9/1991 | Urushibata et al. | 174/88 R X |
| 5,057,650 | 10/1991 | Urushibata et al. | 174/88 R |
| 5,123,986 | 6/1992 | Sugiyama et al. | 174/88 R X |

*Primary Examiner*—Morris H. Nimmo

*Attorney, Agent, or Firm*—Frishauf, Holtz, Goodman & Woodward

[57] ABSTRACT

A junction structure for electrically connecting a plurality of connection conductors at one end of a flat cable, which includes a plurality of electrical conductors arranged parallel in an insulating material, and electrical conductors of a plurality of lead wires. The junction of the flat cable comprises a first fixing member formed integrally with one of the flat cable and the lead wires, and a second fixing member fixing the other of the flat cable and the lead wires to the first fixing member to thereby temporarily connect the respective corresponding electrical conductors of the flat cable and the lead wire.

18 Claims, 6 Drawing Sheets

JUNCTION STRUCTURE FOR A FLAT CABLE

BACKGROUND OF THE INVENTION

1. Field of the Invention

The present invention relates to a junction structure for a flat cable.

2. Description of the Related Art

Flat cables, in which a plurality of electrical conductors are arranged parallel and are covered with an insulating material, are used for wiring on apparatuses which have moving parts. In a roll connector for a steering system of an automobile, for example, a flat cable is loosely stored in a coil shape in a connector case.

Usually, a lead wire is attached to the flat cable for connecting the roll connector to an external apparatus. The cable and the wire are connected by the following methods.

In the first known connecting method, the flat cable and the lead wire are first positioned by means of a jig for aligning electrical conductors of the lead wire with the conductor pitch of the flat cable, before assembling the roll connector. Then, the counterpart conductors are connected respectively by welding or the like, and a cover of plastics or other material is set onto each junction. Thereafter, the flat cable, with the lead wire connected thereto, is housed in the connector case to assemble the roll connector, with the lead wire drawn out of the connector case through an outlet formed in the case. After the roll connector is assembled in this manner, a connector is attached to the other end of the lead wire.

In the second known connecting method, on the other hand, after the roll connector is assembled into a flat cable, having connection conductors at one end thereof, contained in the connector case, the end portion of the flat cable is drawn out through the outlet of the connector case. Then, an insulating material is removed from one end of the lead wire, the other end of which is connected with the connector in advance, whereby the conductors are exposed. The flat cable and the lead wire are fixed at the outlet by means of the positioning jig, the counterpart electrical conductors are connected respectively by welding or clamping, and a cover is then put on the outlet portion.

In either of said known connecting methods, which require a special jig for positioning a flat cable and a lead wire, the efficiency of the connecting operation is rather low. Particularly in the second known connecting method, the flat cable and the lead wire are connected at the outlet of the connector case, so that the jig must be shaped to be matched with the outlet portion. This is costly. Since the cable and the wire have to be connected at the outlet portion, the connecting operation is very difficult.

When welding the flat cable and the lead wire, the conductors are susceptible to misalignment, and the welding operation is difficult, thereby lowering the welding accuracy and the resultant tensile strength despite the use of a positioning jig. Thus, there has been a demand for an improvement of the junction structure of the flat cable.

SUMMARY FOR A INVENTION

The object of the present invention is to provide a junction structure for a flat cable, which enables the flat cable and a lead wire to be connected easily and firmly without using any special jig.

In order to achieve the above object, according to the present invention, there is provided a junction structure for electrically connecting a plurality of connection conductors at one end of a flat cable, which includes a plurality of electrical conductors arranged parallel in an insulating coating, and electrical conductors of a plurality of lead wires, the junction structure comprising a first fixing member connected to one of the flat cable and the lead wires, and a second fixing member to fix the other of the flat cable and the lead wires to the first fixing member, in order to thereby temporarily connect electrical conductors of the flat cable and the lead wires. Preferably, the first fixing member is formed integrally with the flat cable or the lead wires.

The first and second fixing members can hold a flat cable and a lead wire between them without causing any misalignment of the conductors, and temporarily connect the conductors. In this state the conductors are thereafter connected by welding, clamping, or some other method.

According to the junction structure of the flat cable of the present invention, the corresponding electrical conductors of the flat cable and the lead wire can be easily and firmly connected without any misalignment, so that the connecting operation can be more easily performed with a higher efficiency. Moreover, the junction has high tensile strength.

The above and other objects, features, and advantages of the invention will be more apparent from the ensuing detailed description taken in connection with the accompanying drawings.

DETAILED DESCRIPTION

One embodiment of the present invention is described in detail with reference to the accompanying drawings of FIGS. 1 to 7.

Figure 1:
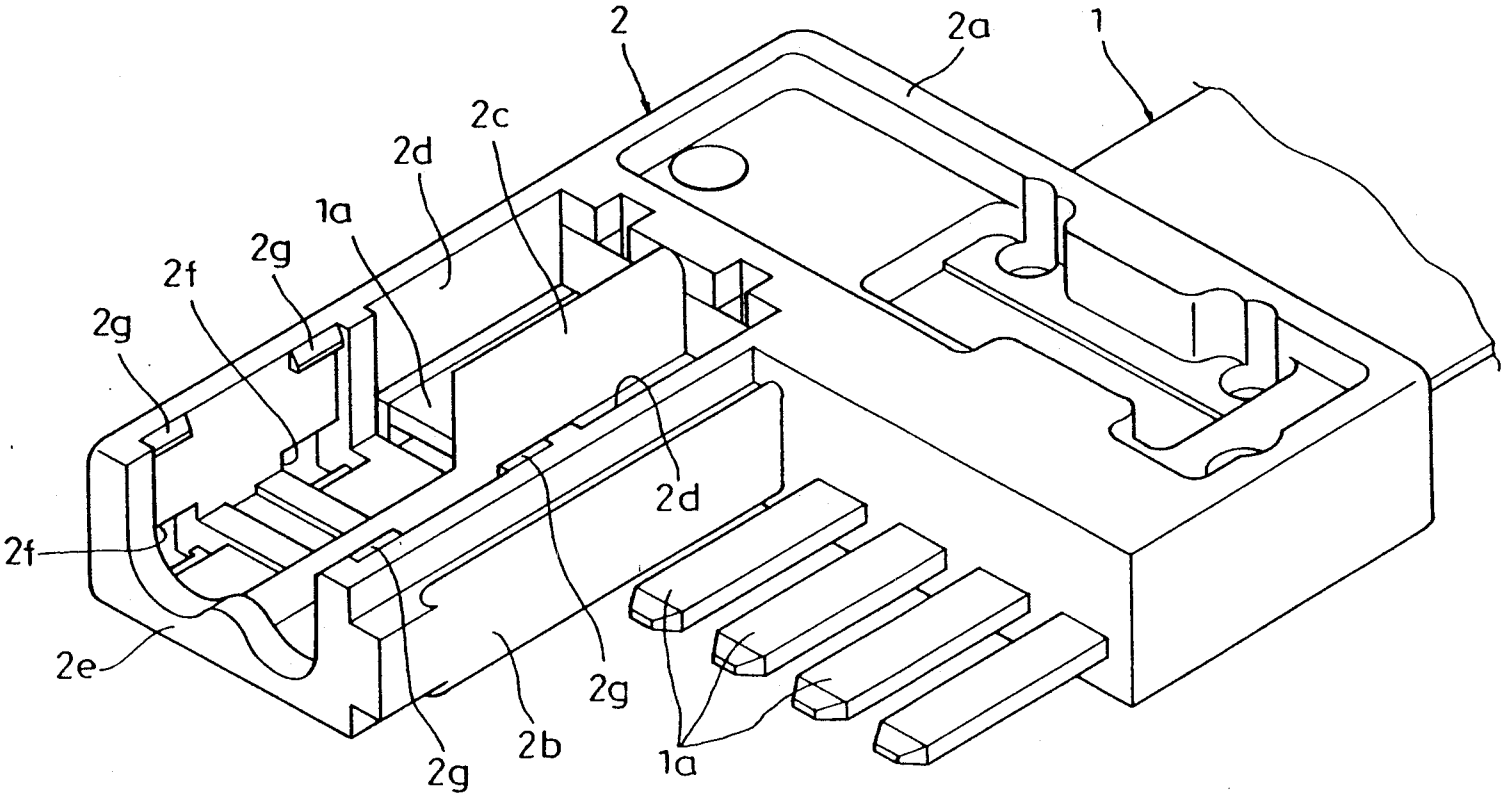
FIG. 1 is an enlarged perspective view illustrating a first fixing member attached to an end portion of a flat cable according to the present invention, the fixing member constituting a junction structure of the cable.

As shown in FIG. 1, a fixing member 2 made of an insulating plastic material, such as polybutylene terephthalate, is attached to an end portion of a flat cable 1, the end portion serving as a junction. The fixing member 2 is the first fixing member. The flat cable 1 is an existing tape-shaped electric cable which includes a plurality of electrical conductors 1*a* covered with an insulating coating.

Figure 2:
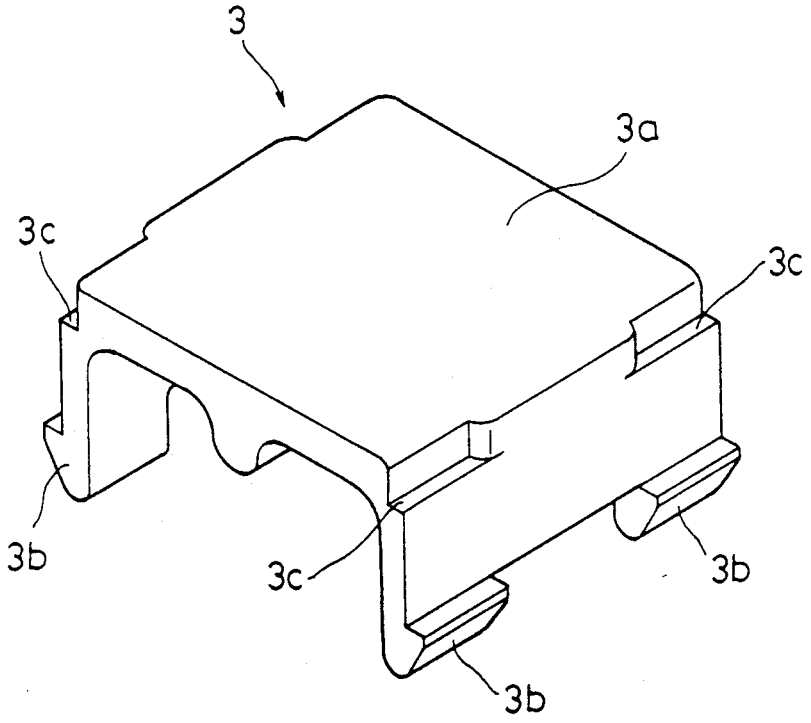
FIG. 2 is an enlarged perspective view of a fixing plate for use as a second fixing member which connects to the first fixing member of FIG. 1.

As shown in FIG. 1, the fixing member 2 comprises a body 2*a* and a cradle 2*b* formed integrally therewith. The body 2*a* is attached to that end portion of the flat cable 1 at which a plurality of connection conductors 1*a* are provided, so that part of each conductor 1*a*, uncovered and exposed, projects from a lateral portion of the body 2*a*. The cradle 2*b* is a portion to which a fixing plate 3, described later with reference to FIG. 2, is engagedly fixed from above to fix a lead wire temporarily. The conductors 1*a* of the flat cable 1 extend into two recesses 2*d* which are divided by means of a partition 2*c*. Four retaining holes 2*f* for retaining the fixing plate 3 are formed on the side of a lead wire inlet portion 2*e* of the cradle 2*b*. Four engaging projections 2*g* protrude from the wall surface of the cradle 2*b*, corresponding individually to the retaining holes 2*f*.

The fixing plate 3 is a second fixing member which is fixed to the fixing member 2 for elastic engagement, and serves to connect the flat cable 1 and the lead wire temporarily. The plate 3, which is made of a plastic material, such as polyester, includes a substantially rectangular base 3*a* and hooks 3*b* protruding downward from the four corners of the base 3*a*, as shown in FIG. 2. Those top portions of the base 3*a* which correspond individually to the hooks 3*b* are cut to form engaging portions 3*c*. The hooks 3*b* are elastically engaged with their corresponding retaining holes 2*f* of the cradle 2*b*, whereby the fixing plate 3 is engagedly fixed to the cradle 2*b*.

In the junction structure of the flat cable according to the present invention, the lead wire is connected to the flat cable 1 in the following manner by means of the fixing member 2 and the fixing plate 3.

Figure 3:
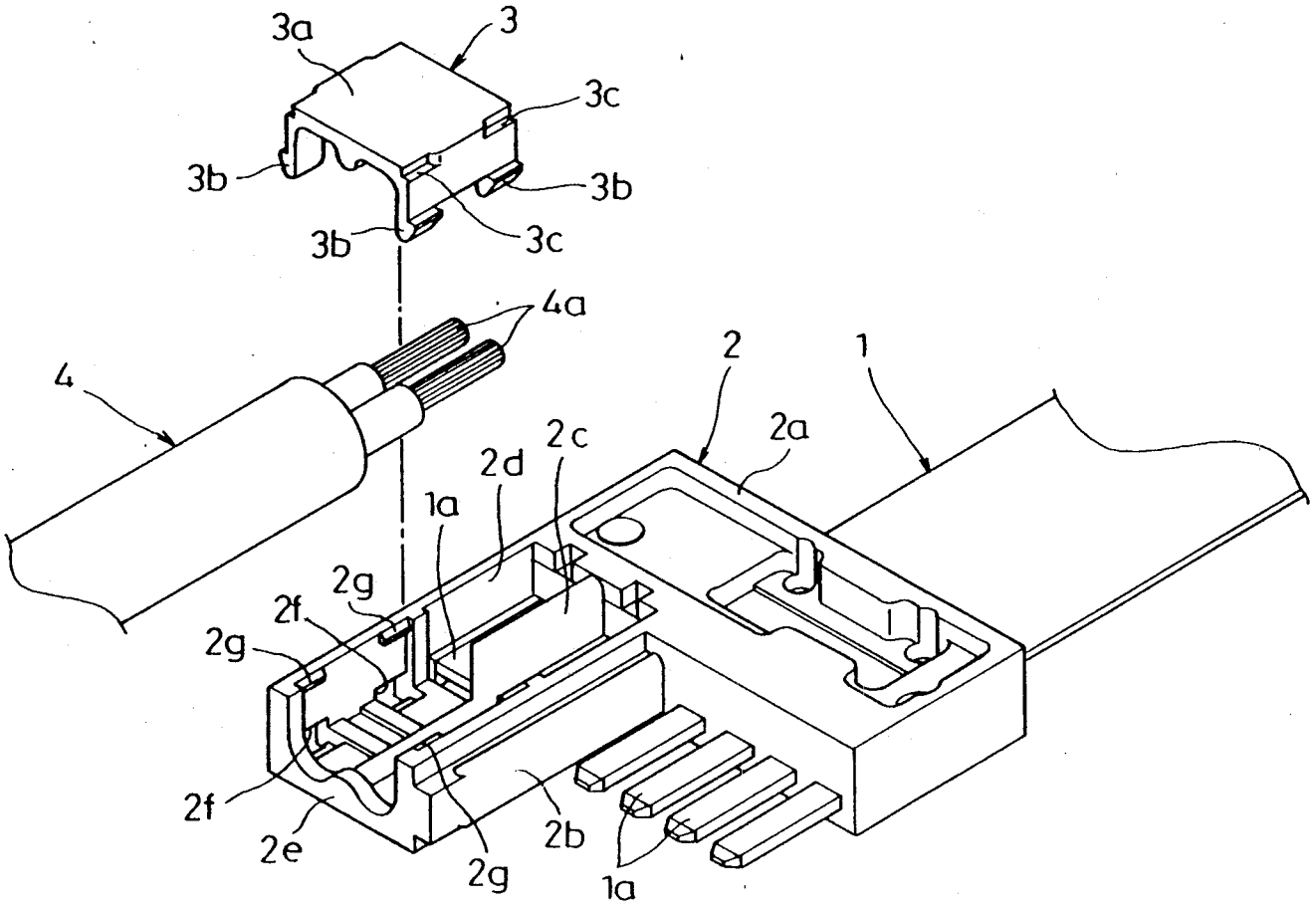
FIG. 3 is an exploded perspective view illustrating the way of fixing a lead wire to the first fixing member by means of a fixing plate.

First, as shown in FIG. 3, the fixing member 2 is mounted to the end portion of the flat cable 1 so that part of each conductor 1*a* projects from a lateral portion of the body 2*a*. Then, the lead wire 4, having electrical conductors 4*a* exposed on its leading end side and the fixing plate 3 are located above the cradle 2*b*.

Thereafter, the conductors 4*a* are set individually in the recesses 2*d* so that they come into contact with their counterpart or corresponding conductors 1*a* of the flat cable 1, and then, the fixing plate 3 is put on the cradle 2*b*. Thereupon, the fixing plate 3 is engagedly fixed to the cradle 2*b* in a manner such that the hooks 3*b* are elastically engaged in their corresponding retaining holes 2*f* of the cradle 2*b*, and the engaging portions 3*c* individually engage the engaging projections 2*g* of the cradle 2*b*.

Figure 4:
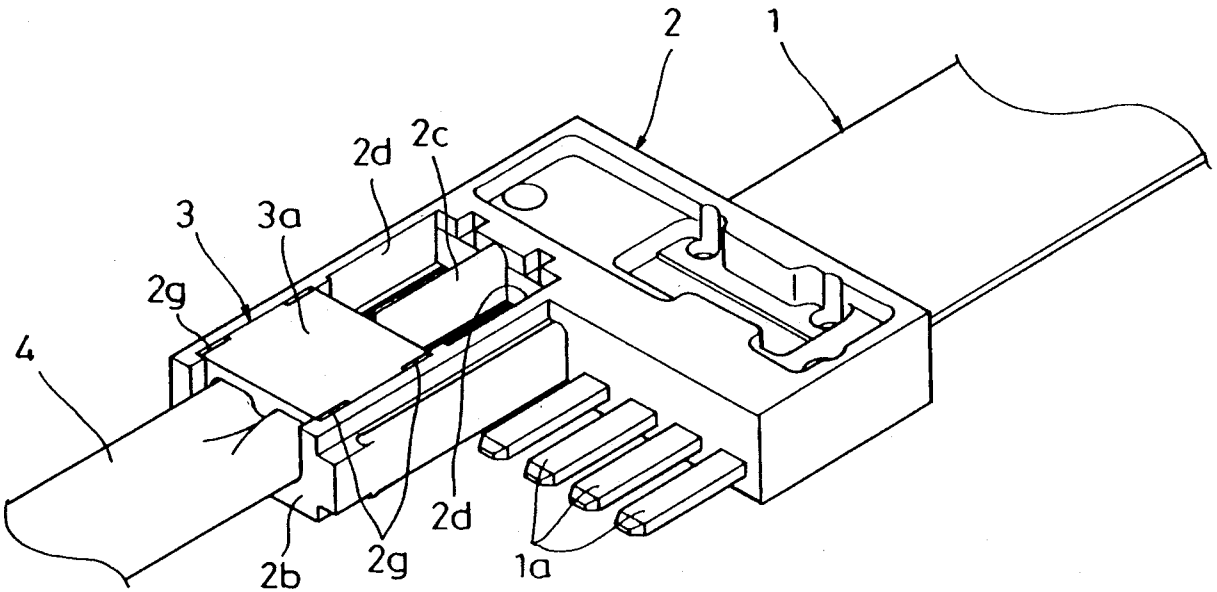
FIG. 4 is a perspective view showing the junction structure of the flat cable connected with the lead wire.

Thus, the lead wire 4 is clamped in between the cradle 2*b* and the fixing plate 3, as shown in FIG. 4, and the respective conductors 1*a* and 4*a* of the flat cable 1 and the lead wire 4 are temporarily connected in their corresponding recesses 2*d* of the cradle 2*b*. In this state, the conductors 4*a* of the lead wire 4 are held in position in the recesses 2*d* of the cradle 2*b*, so that there is no misalignment of the conductors 1*a* and 4*a*.

Thereafter, the electrical conductors 1*a* and 4*a* in the recesses 2*d* are connected respectively by welding, whereby the lead wire 4 is fixed to the cradle 2*b*.

Figure 5:
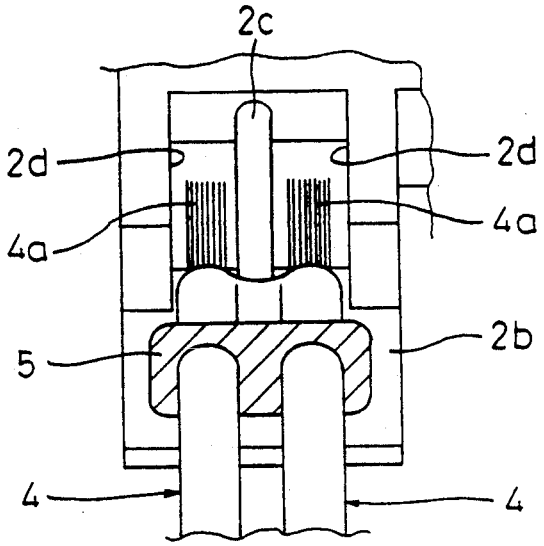
FIG. 5 is a perspective view of the principal part of a modification of the junction structure of the flat cable according to the invention, showing a case in which lead wires are connected to the flat cable and fixed to the first fixing member by means of a retainer for use as the second fixing member.
Figure 6:
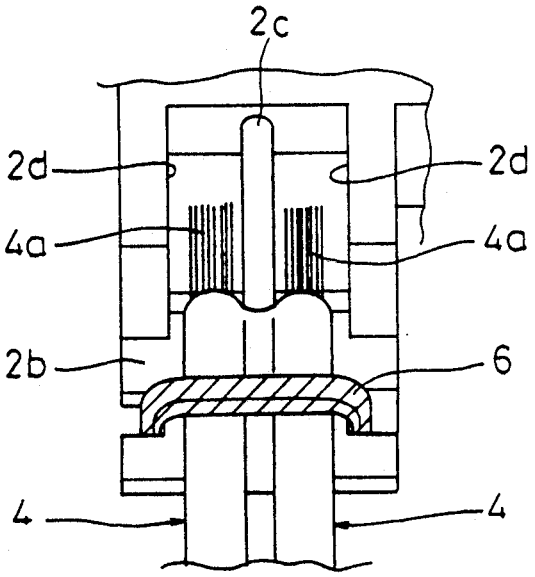
FIG. 6 is a perspective view of the principal part showing a case in which the lead wires are connected to the flat cable and fixed to the first fixing member by means of a fastening member for use as the second fixing member.
Figure 7:
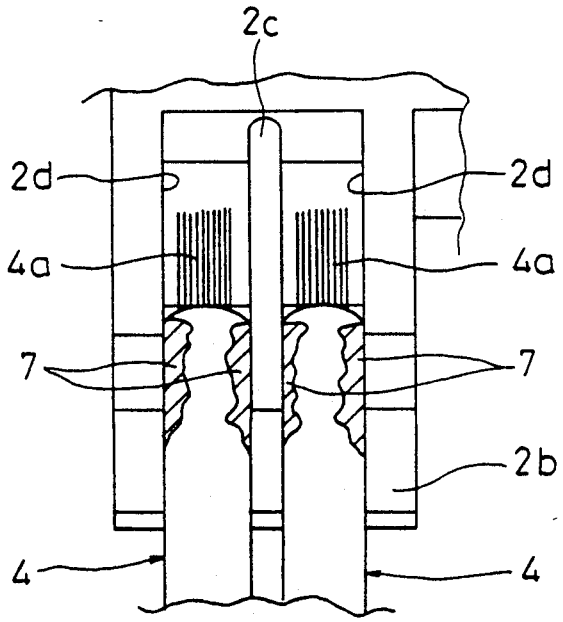
FIG. 7 is a perspective view of the principal part showing a case in which the lead wires are fixed to the first fixing member by means of a bonding agent for use as the second fixing member.

In fixing the flat cable to the fixing member 2 for use as the first fixing member before connecting the cable and the lead wire, for example, the following second fixing members can be used. That is, separate lead wires 4 may be fixed to the cradle 2*b* by means of a retainer 5 mounted in the cradle 2*b* or a fastening member 6, such as a belt, rubber, or string, as shown in FIG. 5 or 6, or by bonding using a bonding agent 7.

Although the fixing member 2 is attached to the flat cable 1 in the embodiment described above, it is to be understood that the member 2 may alternatively be attached to the lead wire 4. In this case, the cradle and the fixing plate may be provided with hooks and retaining holes, respectively.

Further, the electrical conductors of the flat cable themselves may be used as the connection conductors at one end of the flat cable, or, as in the above embodiment, plate-like electrical conductors may be attached to the electrical conductors of the flat cable.

What is claimed is:

1. A junction structure for electrically connecting a plurality of electrical conductors of a flat cable to a plurality of electrical conductors of a lead wire, the electrical conductors of the flat cable being arranged parallel to each other at a predetermined pitch and covered with an insulating coating, the junction structure comprising:

a first fixing member fixedly connected to one of the flat cable and the lead wire; and a second fixing member including means for mechanically fixing the other of the flat cable and the lead wire to the first fixing member, and for temporarily fixing exposed ends of the electrical conductors of the lead wire adjacent to exposed ends of corresponding electrical conductors of the flat cable such that exposed ends of the electrical conductors of the lead wire and of the corresponding electrical conductors of the flat cable are in alignment at respective junctions and are prevented from moving out of said alignment, before the exposed ends of the electrical conductors of the lead wire and of the corresponding electrical conductors of the flat cable are respectively electrically connected together at said respective junctions.

2. The junction structure according to claim 1, wherein:

said second fixing member comprises a plurality of hooks; and said first fixing member comprises a plurality of retaining holes formed therein, said retaining holes corresponding in position to positions of the hooks, respectively, for elastic engagement with the hooks, to couple said first and second fixing members together.

3. The junction structure according to claim 1, further comprising coupling means for coupling said first fixing member to said second fixing member.

4. The junction structure according to claim 3, wherein said coupling means comprises at least one retaining hole in said first fixing member, and at least one resilient hook on said second fixing member for elastically engaging said at least one retaining hole.

5. The junction structure according to claim 1, wherein said first and second fixing members are each made of an electrically insulating plastic material.

6. The junction structure according to claim 1, wherein said second fixing member comprises a retainer member.

7. The junction structure according to claim 1, wherein said second fixing member comprises a fastening member.

8. The junction structure according to claim 1, wherein said second fixing member comprises a bonding agent.

9. The junction structure according to claim 1, wherein said first fixing member is formed integrally with the flat cable.

10. The junction structure according to claim 1, wherein said first fixing member is formed integrally with one of the flat cable and the lead wire.

11. The junction structure according to claim 10, wherein:

said second fixing member comprises a plurality of hooks; and said first fixing member comprises a plurality of retaining holes formed therein, said retaining holes corresponding in position to positions of the hooks, respectively, for elastic engagement with the hooks, to couple said first and second fixing members together.

12. The junction structure according to claim 10, further comprising coupling means for coupling said first fixing member to said second fixing member.

13. The junction structure according to claim 12, wherein said coupling means comprises at least one retaining hole in said first fixing member, and at least one resilient hook on said second fixing member for elastically engaging said at least one retaining hole.

14. The junction structure according to claim 10, wherein said first and second fixing members are each made of an electrically insulating plastic material.

15. The junction structure according to claim 10, wherein said second fixing member comprises a retainer member.

16. The junction structure according to claim 10, wherein said second fixing member comprises a fastening member.

17. The junction structure according to claim 10, wherein said second fixing member comprises a bonding agent.

18. The junction structure according to claim 10, wherein said first fixing member is formed integrally with the flat cable.

* * * * *